US011788266B2

(12) United States Patent
Ahuja et al.

(10) Patent No.: US 11,788,266 B2
(45) **Date of Patent: *Oct. 17, 2023**

(54) SINK DRAIN PIPE WITH AND WITHOUT OVERFLOW PORTS

(71) Applicant: PF Waterworks LP, Houston, TX (US)

(72) Inventors: Sanjay Ahuja, Katy, TX (US); Harold Kent Beck, Copper Canyon, TX (US)

(73) Assignee: PF Waterworks LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/526,175

(22) Filed: Nov. 15, 2021

(65) Prior Publication Data

US 2022/0074178 A1 Mar. 10, 2022

Related U.S. Application Data

(62) Division of application No. 17/027,147, filed on Sep. 21, 2020, now Pat. No. 11,193,261, which is a division of application No. 16/018,308, filed on Jun. 26, 2018, now Pat. No. 10,808,386.

(51) Int. Cl.
*E03C 1/22* (2006.01)

(52) U.S. Cl.
CPC ..... *E03C 1/22* (2013.01)

(58) Field of Classification Search
CPC ... E03C 1/14; E03C 1/182; E03C 1/22; E03C 1/232; E03C 2001/2413
See application file for complete search history.

(56) References Cited

U.S. PATENT DOCUMENTS

| | | | | |
|---|---|---|---|---|
| 711,845 | A | 10/1902 | Fountain et al. | |
| 3,680,153 | A | 8/1972 | Haldopoulos et al. | |
| 4,432,565 | A | 2/1984 | Ohannesian et al. | |
| 4,807,306 | A | 2/1989 | Hayman et al. | |
| 5,274,861 | A | 1/1994 | Ford | |
| 10,808,386 | B2 * | 10/2020 | Beck | E03C 1/14 |
| 2006/0108558 | A1 | 5/2006 | Wooldridge | |
| 2008/0017250 | A1 | 1/2008 | Butler | |

(Continued)

FOREIGN PATENT DOCUMENTS

| | | |
|---|---|---|
| DE | 4414888 A1 | 11/1995 |
| DE | 196-49-239 | 1/1998 |

*Primary Examiner* — J C Jacyna
(74) *Attorney, Agent, or Firm* — Stephen S. Hodgson

(57) ABSTRACT

A conventional bathroom sink has an overflow port and an overflow conduit. A conventional drain pipe for the conventional sink has overflow ports in fluid communication with the sink's overflow port. A vessel sink does not have an overflow port. A prior art drain pipe that does not have overflow ports has been used with vessel sinks. The present invention provides a new drain pipe with overflow ports for a conventional sink and means for covering and sealing the overflow ports in the new drain pipe so that the new drain pipe can also be used with a vessel sink that does not have an overflow port. Means for covering and sealing the overflow ports include an inner sleeve that fits inside the drain pipe, an outer sleeve that surrounds the drain pipe and grommets and hole plugs that that fit inside the overflow ports, where all of the means cover and seal the overflow ports so that the new drain pipe does not leak when used with a vessel sink that does not have an overflow port.

8 Claims, 5 Drawing Sheets

(56) References Cited

U.S. PATENT DOCUMENTS

| | | | |
|---|---|---|---|
| 2010/0180966 | A1 | 7/2010 | George |
| 2011/0185494 | A1 | 8/2011 | Beck et al. |
| 2013/0227780 | A1 | 9/2013 | Thommelin et al. |
| 2016/0208470 | A1 | 7/2016 | Franke |
| 2017/0204592 | A1 | 7/2017 | Chen |
| 2017/0314244 | A1 | 11/2017 | Beck et al. |

* cited by examiner

SINK DRAIN PIPE WITH AND WITHOUT OVERFLOW PORTS

CROSS REFERENCE TO RELATED APPLICATIONS

This is a continuation application of U.S. patent application Ser. No. 16/018,308 filed on Jun. 26, 2018, which issued as U.S. Pat. No. 10,808,386, and is a divisional application of U.S. patent application Ser. No. 17/027,147 filed on Sep. 21, 2020, which is a divisional application of the U.S. application Ser. No. 16/018,308. The U.S. application Ser. No. 17/027,147 issued as U.S. Pat. No. 11,193,261. This application claims priority to and the benefit of U.S. Provisional Patent Application Ser. No. 62/526,794, filed Jun. 29, 2017, which is incorporated by reference. This application is related to the present inventors' U.S. patent application Ser. No. 15/584,027 filed May 2, 2017, which issued as U.S. Pat. No. 10,240,329; Ser. No. 15/584,030 filed May 2, 2017, which issued as U.S. Pat. No. 10,301,803; and Ser. No. 15/913,452 filed Mar. 6, 2018, each of which is incorporated by reference.

BACKGROUND OF THE INVENTION

1. Field of the Invention

This present invention pertains to a drain pipe or drain body that attaches to a sink at a drain opening for draining water from the sink and more particularly to a drain pipe that can be used with a sink that has or that does not have an overflow port.

2. Description of the Related Art

One type of sink that is used in a bathroom or restroom has an overflow port for diverting water into a drain pipe below a drain opening in the sink in the event the drain opening is closed while water continues to run into the sink. The drain pipe has a port, and an overflow conduit, which is typically built into the sink, allows water to flow from the sink's overflow port to the drain pipe's overflow port and into the drain pipe. Another type of sink, which is known as a vessel sink, does not have an overflow port. A drain pipe that does not have an overflow port is used for the vessel sink. Retail stores and plumbing supply businesses typically keep an inventory of each type of drain pipe. Sometimes a mistake is made, and a drain pipe with an overflow port is installed on a vessel sink that does not have and overflow port. The overflow port on the drain pipe may not be sealed due a difference in the thickness of the two types of sinks, which allows water to leak from the drain pipe's overflow port. Another mistake that can be made is to install a drain pipe that does not have an overflow port in a sink that has an overflow port, which causes the sink's overflow port to be nonfunctional.

SUMMARY OF THE INVENTION

A drain body is provided for connection to a sink having a drain opening, where the drain body includes a pipe having a sidewall, a length and opposing upper and lower ends, where the sidewall defines an interior fluid flow passageway in the pipe; a flange on the upper end that extends radially, where the flange and pipe are sized so that the pipe will pass through the drain opening, and where the flange will not pass through the drain opening; a port in the sidewall for receiving water from the sink through an overflow channel if the sink has an overflow port; and means for sealing the port in the sidewall if the sink does not have an overflow port.

Means for sealing the port in the sidewall of the pipe include a cover and a sleeve. Types of covers include a resilient grommet, a hole plug pressed into the port after the pipe is made, a hole plug that has external threads that match external threads on the sidewall of the pipe, a knock-out hole plug formed integral with pipe that can be broken out and removed to provide the port in the sidewall and a sheet with adhesive that is glued or bonded to the sidewall to cover and seal the port. The sleeve can be an inside sleeve or an outside sleeve, either of which is proximate to the sidewall for covering the sealing the port. The inside sleeve may be a standalone tube or a tube that is attached to the underside flange. The outside sleeve may be in threaded engagement with external male threads on the sidewall of the pipe.

A kit can be made and sold that includes a drain pipe having a sidewall with a port in its sidewall, a drain flange formed integral with or attachable to an upper end of the drain pipe and at least one means for covering and sealing the port in the sidewall of the drain pipe. The kit can be used with a sink that does not have an overflow port by using the means for covering and sealing the port in the sidewall of the drain pipe. The kit can be used with a sink that has an overflow port by not using the means for covering and sealing the port in the sidewall of the drain pipe.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

Figure 1:
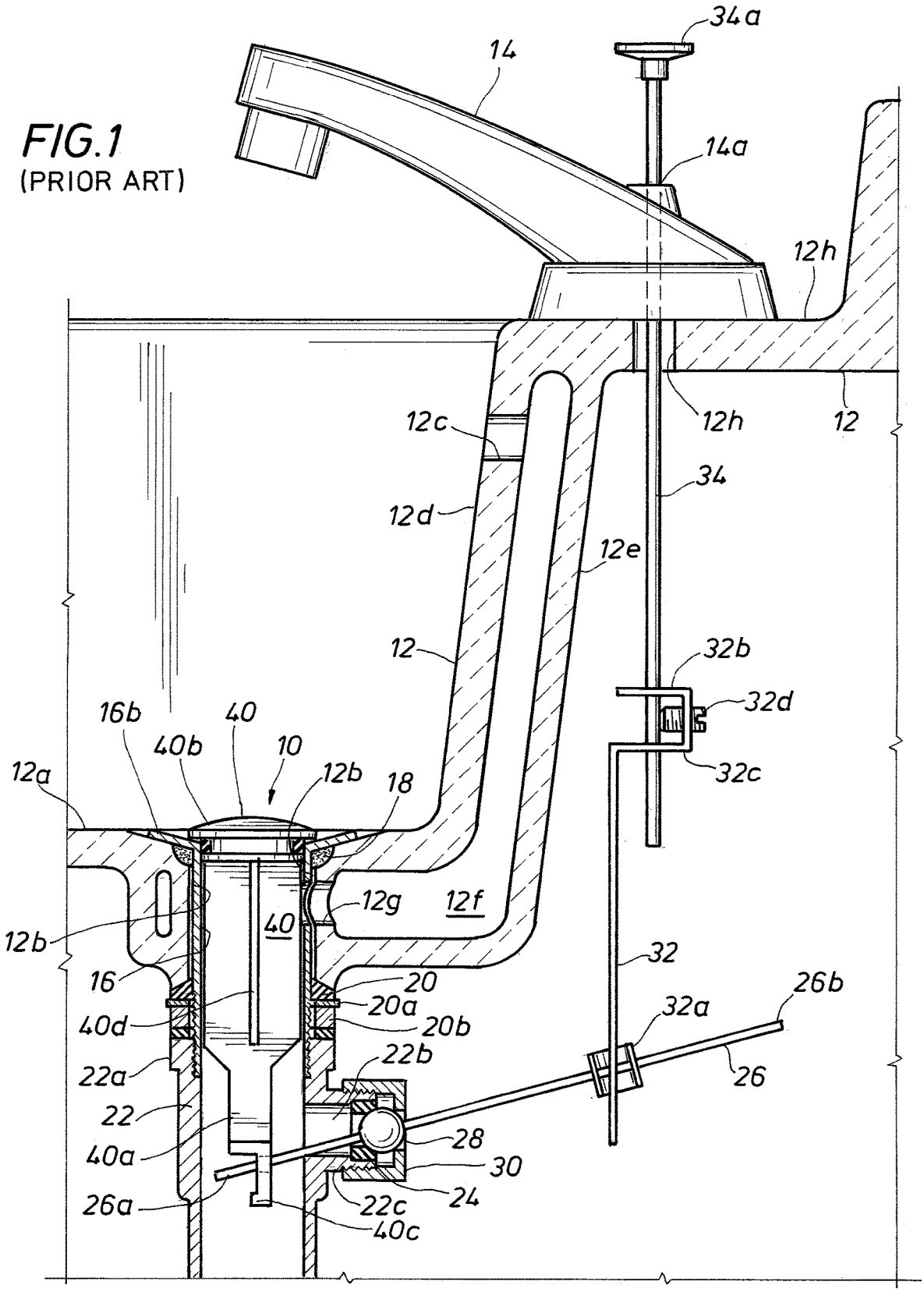
FIG.1 (PRIOR ART)
FIG. 1 is a cross-section of a side elevation of a sink with an overflow port and a drain pipe with an overflow port in fluid communication with the overflow port of the sink, according to the prior art.
Figure 2:
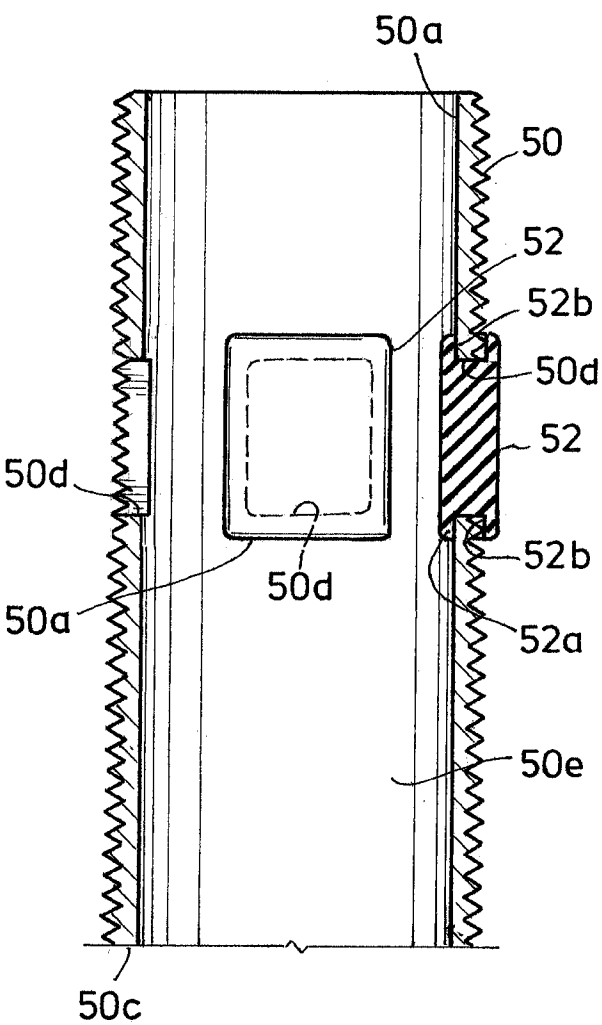
FIG. 2 is a cross-section of a side elevation of a drain pipe for a sink, according to the present invention.

A discussion of the prior art will be helpful in understanding the present invention. FIG. 1 is a side elevation in cross-section of a prior art pop-up drain assembly 10 in a sink or basin 12. The pop-up drain assembly 10 is received in the sink or basin 12, which is typical for a bathroom, restroom or lavatory. Sink 12 has a lower surface 12*a* that drains into a drain opening 12*b*. Sink 12 has an overflow port 12*c* in a side wall 12*d*. An outer wall 12*e* and side wall 12*d* define an overflow conduit or channel 12*f*, and side wall 12*d* has an overflow drain port 12*g* for draining overflow fluid into a port in drain assembly 10. A faucet 14 is mounted on a top deck 12*h* of sink 12 for supplying water or other fluid to sink 12. Pop-up drain assembly 10 comprises a drain flange 16 that fits down through drain opening 12*b* in sink 12. Drain flange 16 has a threaded tubular portion extending essentially throughout its full length, and a flange 16*b* extends radially outwardly on a top end. Flange 16*b* is shown in FIG. 1 as formed integral with the tubular body of drain flange 16, but FIG. 2 in the present inventors' U.S. application Ser. No. 15/584,030 (Pub. No. 2017/0314244 A1) shows a more typical arrangement in which the flange portion is in threaded engagement with the tubular portion. FIG. 2 in the present inventors' U.S. application Ser. No. 15/584,030 shows a drain pipe that comprises a drain flange and a separate drain tube, which is in a threaded engagement with the drain flange. A gasket or plumber's putty 18 provides a seal between the lower surface 12*a* of the sink 12 and the flange 16*b* of drain flange 16. A flexible gasket 20 and a washer 20*a* are placed around a bottom portion of drain flange 16 and then pressed tightly against a bottom surface of sink 12 with a threaded nut 20*b*. A drain body 22 is threaded onto a lower end of drain flange 16. Drain body 22 has a wrench flange 22*a* for receiving a wrench for tightening and loosening drain body 22 with respect to drain flange 16. Drain body 22 has a pivot rod port 22*b*, and a threaded tubular stub 22*c* projects radially outwardly from drain body 22. A pivot rod seal 24 is received in stub 22*c*.

A pivot rod 26 has a stopper end 26*a* and an outer end 26*b*. A pivot ball 28 is sealingly received on pivot rod 26 closer to stopper end 26*a* than outer end 26*b*. Pivot rod 26 is received in stub 22*c* such that stopper end 26*a* is inside the drain body 22, and the stopper ball 28 rests against pivot rod seal 24. A pivot rod cap 30 is threaded onto stub 22*c* sufficiently tightly to seal pivot ball 28 against pivot rod seal 24, but loose enough to allow pivot ball 28 and pivot rod 26 to pivot. An extension rod 32 having a plurality of holes, which are not shown, is received on outer end 26*b* of pivot rod 26 and held in place by a clip 32*a*. Extension rod 32 is bent so as to have two parallel portions 32*b* and 32*c* that are perpendicular to the longitudinal axis of the extension rod 32, and each of the two parallel portions has a hole through which a control rod 34 is received. Control rod 34 passes through a faucet port 14*a* and a sink control rod port 12*h*. Control rod 34 has a knob 34*a* at an upper end, and control rod 34 is fastened to extension rod 32 by a set screw 32*d*.

A stopper 40 is received in drain flange 16 and drain body 22. Stopper 40 has an elongate shaft 40*a* running its length, which has a longitudinal axis through the center of stopper 40. A cap 40*b* is located on an upper end while the drain assembly 10 is installed and operational, and a pivot rod receiving member 40*c* is located on an opposing lower end. The pivot rod receiving member 40*c* defines an opening through which stopper end 26*a* of pivot rod 26 protrudes for engaging and moving stopper 40, and pivot rod receiving member 40*c* may be referred to as open member 40*c*. Four flanges or fins, referred to collectively as fins 40*d*, extend longitudinally along shaft 40*a* and project radially, and fins 40*d* lie in two perpendicular and intersecting planes. The fins provide structural support for the shaft and center the stopper in the drain pipe.

A vessel sink (not shown) does not have an overflow port or overflow conduit such as overflow port 12*c* and overflow conduit 12*f* shown in FIG. 1. The thickness of a vessel sink may be similar to the thickness of side wall 12*d* in FIG. 1. There have been many instances in which a drain pipe with an overflow port has been installed on a vessel sink, where the overflow port in the drain pipe was not sealed and leaked.

The present invention provides in one embodiment a drain pipe that has an overflow port and a device or a means for covering and sealing the overflow port in the drain pipe when the overflow port is not needed. Consequently, a retail store or a plumbing supply store does not need to have an inventory of both types of drain pipes, as one drain pipe with an overflow port and a means for covering and sealing the overflow port can be used in either application.

With respect to the present invention, FIG. 2 is a side elevation in cross-section of a drain pipe 50 similar to the tubular portion of the drain flange 16 in FIG. 1. Drain pipe 50 is very similar to the drain tube 54*b* in FIG. 2 of the present inventors' U.S. application Ser. No. 15/584,030 (Pub. No. 2017/0314244 A1). Drain pipe 50 has a sidewall 50*a*, an upper end 50*b*, a lower end 50*c* and a plurality of overflow ports 50*d*, which are openings through the sidewall 50*a*. The sidewall 50*a* defines an interior fluid flow passageway 50*e* in the drain pipe 50. Overflow ports 50*d* are shown as having a rectangular shape, but may have any other shape such as circular and square. A grommet 52 has a shape and size suitable for covering and sealing one of the overflow ports 50*d*. Grommet 52 has a perimeter 52*a* that is slightly larger than one of the overflow ports 50*d* defined by the sidewall 50*a*. Grommet 52 has a groove 52*b* along the perimeter 52*a*. The groove 52*b* is about the same size as, but slightly smaller than, the one of the overflow ports 50*d*. Grommet 52 is preferably resilient so that it can bend and compress and is preferably made of a rubber or elastomeric material. One grommet 52 is inserted in each overflow port 50*d* for covering and sealing the overflow ports 50*d*. The portion of the sidewall 50*a* that defines one of the ports 50*d* is received in the groove 52*b*. The grommet 52 presses against or is close to the sidewall 50*a* so as to cover and seal one of the overflow ports 50*d*, thereby preventing water in the interior fluid flow passageway 50*e* from leaking out through the port 50*d*. One grommet 52 would be pressed into each overflow port 50*d*. A kit that includes the drain pipe 50 and a grommet 52 for each overflow port 50*d* can be sold. The kit can further include a pop-up drain assembly such as described in the present inventors' related applications.

Figure 3:
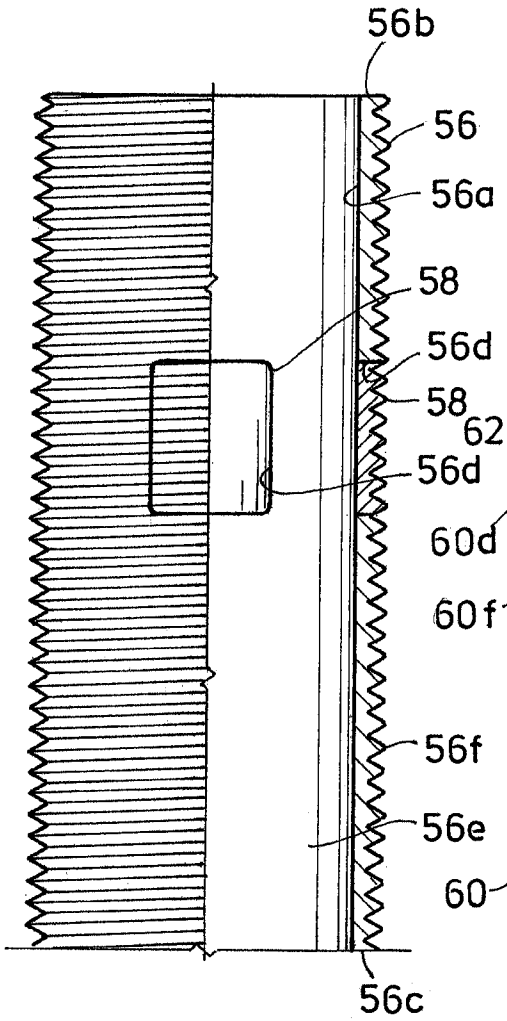
FIG. 3 is a cross-section of a side elevation of a drain pipe for a sink, according to the present invention.

FIG. 3 is a side elevation in cross-section of a drain pipe 60 similar to the drain pipe 50 in FIG. 2. Drain pipe 56 has a sidewall 56*a*, an upper end 56*b*, a lower end 56*c* and a plurality of overflow ports 56*d*, which are openings through the sidewall 56*a*. The sidewall 56*a* defines an interior fluid flow passageway 56*e* in the drain pipe 56. The sidewall 56*a* has external male threads 56*f*. A hole plug 58 is pressed into an overflow port 56*d* in a tight, sealing fit with the portion of the sidewall 56*a* that defines the port 56*d*. The hole plug 58 may protrude outwardly somewhat after installation and may have a smooth outer surface. However, in one embodiment, the hole plug 58 has male threads on an external surface that match with the male threads 56*f* on the sidewall 56*a*, and in this embodiment a nut (not shown) having internal female threads can be screwed over the hole plugs 58 to hold them securely engaged with the sidewall 56*a* to seal the overflow ports 56*d*.

Figure 4:
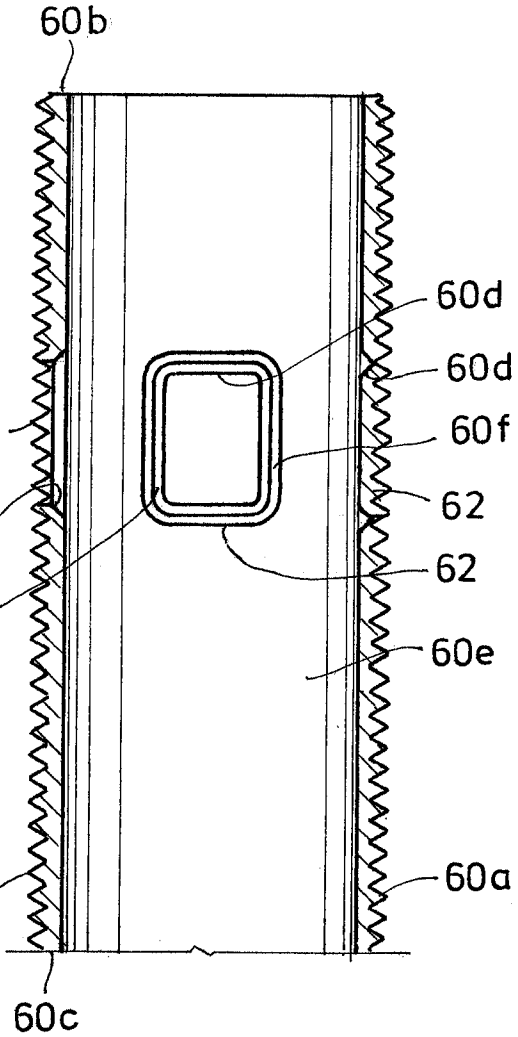
FIG. 4 is a cross-section of a side elevation of a drain pipe for a sink, according to the present invention.

FIG. 4 is a side elevation in cross-section of a drain pipe 60 similar to the drain pipe 50 in FIG. 2. Drain pipe 60 has a sidewall 60*a*, an upper end 60*b*, a lower end 60*c*, a plurality of overflow ports 60*d* and an interior fluid flow passageway 60*e*. A knock-out hole plug 62 covers and seals each of the overflow ports 60*d*. The knock-out hole plugs 62 are formed integral with the sidewall 60*a* of the drain pipe 60 or are inserted into overflow ports 60*d* and fastened to the sidewall 60*a* to cover and seal the overflow ports 60*d*. If the drain pipe 60 is to be used with a sink that has an overflow port and an overflow conduit, then the knock-out hole plugs are knocked out, punched out or broken out so that water can flow from the sink's overflow port through the overflow conduit and into the interior fluid flow passageway 60*e* through the overflow ports 60*d*. If the drain pipe 60 is to be used with a sink that does not have an overflow port, presumably a vessel sink, then the knock-out hole plugs 62 are left in place so that water does not leak out through the overflow ports 60*d*. A V-shaped notch 60*f* can be formed in the sidewall 60*a* to provide a line of weakness around the perimeter of what will become an overflow port 60*d* if the knock-out plug 62 is removed from the sidewall 60*a*.

Figures 5, 6, 7:
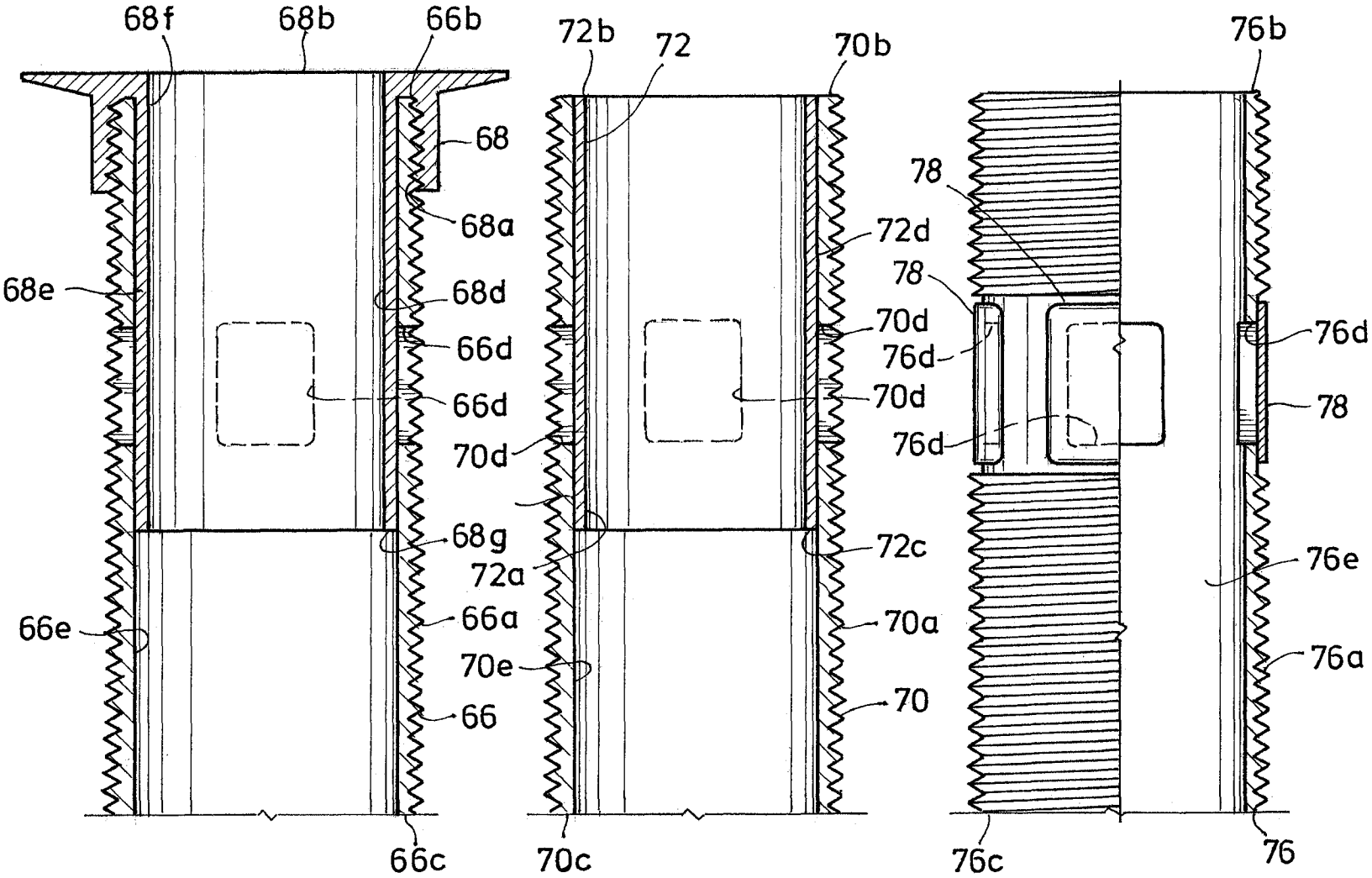
FIG. 5 is a cross-section of a side elevation of a drain pipe for a sink, according to the present invention.
FIG. 6 is a cross-section of a side elevation of a drain pipe for a sink, according to the present invention.
FIG. 7 is a cross-section of a side elevation of a drain pipe for a sink, according to the present invention.

FIG. 5 is a side elevation in cross-section of a drain pipe 66 similar to the drain pipe 50 in FIG. 2. Drain pipe 66 has a sidewall 66*a*, an upper end 66*b*, a lower end 66*c*, a plurality of overflow ports 66*d* and an inside surface 66*e*. A flange 68 has female threads 68*a* in threaded engagement with the upper end 66*b* of drain pipe 66. The male and female threads can be reversed, and the flange 68 can be made integral with the drain pipe 66, or a press fit can be used. Flange 68 has an upper, outer surface 68*b* and an inner, lower surface 68*c*. A cylindrical, tubular sleeve 68*d* depends downwardly from the inner, lower surface 68*c*. A gap is defined between an outer surface 68*e* and the female threads 68*a* in the flange 68. The upper end 66*b* of the drain pipe 66 fits with little clearance (somewhat snugly) in the gap. The tubular sleeve 68*d* has an upper end 68*f* attached to or formed integral with the flange 68 and an opposing lower end 68*g*. The lower end 68*g* of the sleeve 68*d* extends below the overflow ports 66*d*. The outer surface 68*e* of the sleeve 68*d* is very close to or proximate to or adjacent to the inside surface 66*e* of the drain pipe 66 and below the overflow ports 66*d*, thereby covering and sealing the overflow ports 66*d*.

FIG. 6 is a side elevation in cross-section of a drain pipe 70 similar to the drain pipe 50 in FIG. 2. Drain pipe 70 has a sidewall 70*a*, an upper end 70*b*, a lower end 70*c*, a plurality of overflow ports 70*d* and an inside surface 70*e*. A cylindrical, tubular sleeve 72 has a sidewall 72*a*, an upper end 72*b*, a lower end 72*c* and an outside surface 72*d*. Sleeve 72 fits inside drain pipe 70 such that the outside surface 72*d* of sleeve 72 is very close to or proximate to or adjacent to the inside surface 70*e* of the drain pipe 70. Sleeve 72 has a length long enough to cover the overflow ports 70*d* in the drain pipe 70. Sleeve 72 can be held in place by a pressure fit, a compression fit, a friction fit or by an adhesive. Sleeve 72 covers and seals the overflow ports 70*d*.

FIG. 7 is a side elevation in cross-section of a drain pipe 76 similar to the drain pipe 50 in FIG. 2. Drain pipe 76 has a sidewall 76*a*, an upper end 76*b*, a lower end 76*c*, a plurality of overflow ports 76*d* and an interior fluid flow passageway 76*e*. A continuous strip or patches 78 of an adhesive-backed or coated material is secured or pressed into engagement with the sidewall 76*a* for covering and sealing the overflow ports 76*d*. In its simplest form, a piece of duct tape can be wrapped around sidewall 76*a* to cover and seal the overflow ports 76*d*. However, a more elegant solution is envisioned in which the material may be decorative, such as matching or accenting the color of the drain pipe 76, and the material may be a metallic foil or a resilient polymeric material. It may be preferable to thread a nut over the material or to clamp the material to the sidewall 76*a* in addition to or instead of the adhesive.

Figure 8:
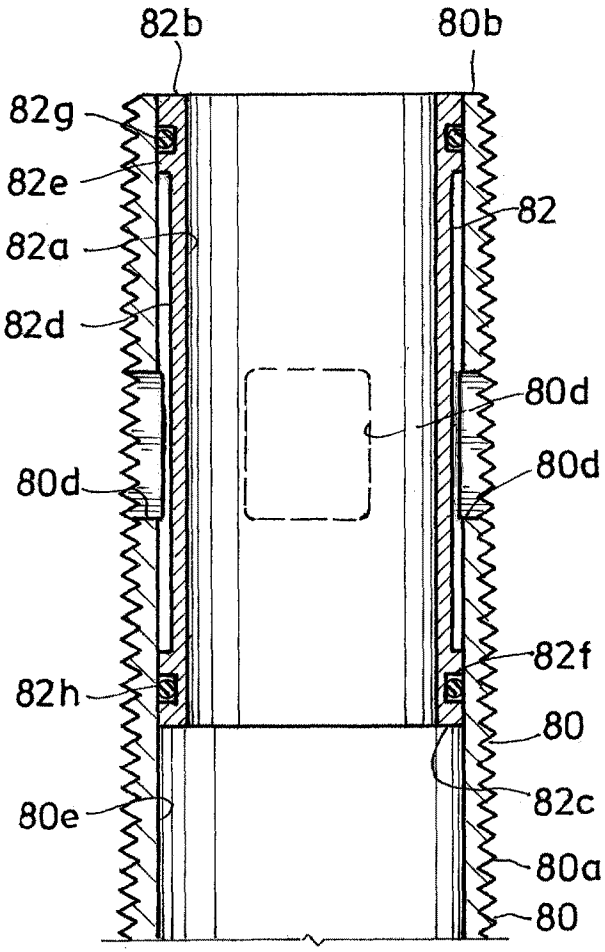
FIG. 8 is a cross-section of a side elevation of a drain pipe for a sink, according to the present invention.

FIG. 8 is a side elevation in cross-section of a drain pipe 80 similar to the drain pipe 50 in FIG. 2. Drain pipe 80 has a sidewall 80*a*, an upper end 80*b*, a lower end 80*c*, a plurality of overflow ports 80*d* and an inside surface 80*e*. A cylindrical, tubular sleeve 82 has a sidewall 82*a*, an upper end 82*b*, a lower end 82*c* and an outside surface 82*d*. Sleeve 82 fits inside drain pipe 80 such that the outside surface 82*d* of sleeve 82 is close to or near the inside surface 80*e* of the drain pipe 80. Sleeve 82 has a length long enough to cover the overflow ports 80*d* in the drain pipe 80. Sleeve 82 has an upper circumferential groove 82*e* near its upper end 82*b* and a lower circumferential groove 82*f* near its lower end 82*c*. An upper O-ring, seal or gasket 82*g* is received in the upper groove 82*e*, and a lower O-ring, seal or gasket 82*h* is received in the lower groove 82*f*. Sleeve 82 covers and seals the overflow ports 80*d*. A kit that includes the items described with reference to FIG. 8 and a drain flange can be sold, preferably with the sleeve 82 uninstalled. If the application is for a vessel sink without an overflow port, the seals 82*g* and 82*h* can be placed on the sleeve 82, and the sleeve 82 can be inserted into the drain pipe 80 to cover and seal the overflow ports 80*d*.

Figure 9:
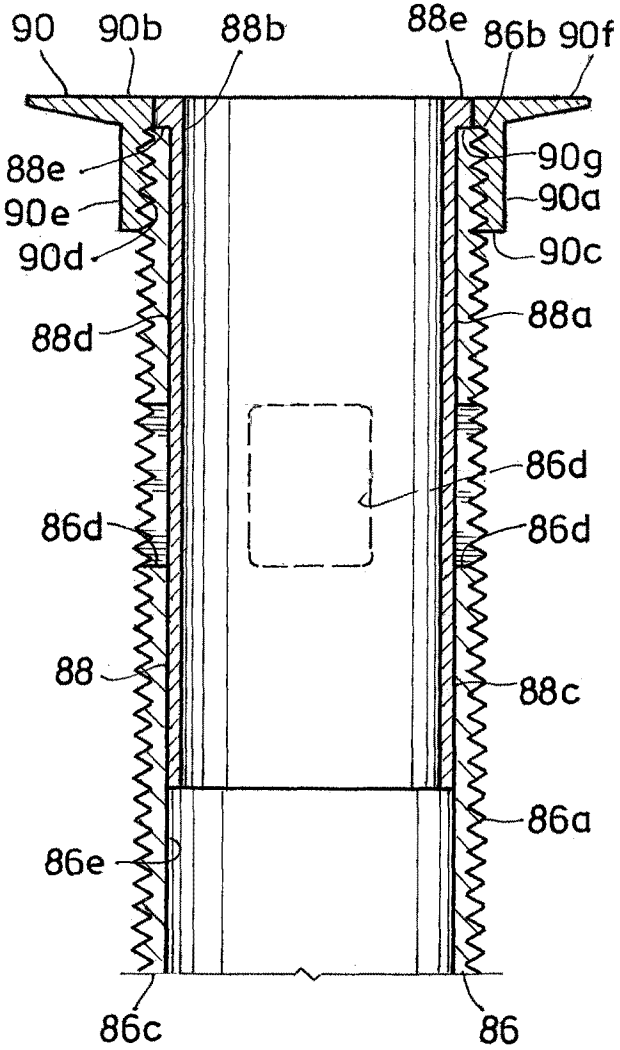
FIG. 9 is a cross-section of a side elevation of a drain pipe for a sink, according to the present invention.

FIG. 9 is a side elevation in cross-section of a drain pipe 86 similar to the drain pipe 50 in FIG. 2. Drain pipe 86 has a sidewall 86*a*, an upper end 86*b*, a lower end 86*c*, a plurality of overflow ports 86*d* and an inside surface 86*e*. A cylindrical, tubular sleeve 88 has a sidewall 88*a*, an upper end 88*b*, a lower end 88*c* and an outside surface 88*d*. Sleeve 88 also has a outwardly extending radial flange 88*e* at its upper end 88*b* that projects radially with respect to the longitudinal axis of sleeve 88. Sleeve 88 fits inside drain pipe 86 such that the outside surface 88*d* of sleeve 88 is close to or near the inside surface 86*e* of the drain pipe 86. Sleeve 88 has a length long enough to cover the overflow ports 86*d* in the drain pipe 86. A drain flange 90 has a sidewall 90*a*, an upper end 90*b*, a lower end 90*c*, an inside surface 90*d* of the sidewall 90*a*, an outside surface 90*e* of the sidewall 90*a*, an outwardly extending radial flange 90*f* that would rest on a bottom surface of a sink and surround a drain opening and an inwardly extending radial flange 90*g* that provides a shoulder that the upper end 86*b* of the drain pipe 86 abuts. The upper end 86*b* of the drain pipe 86 also abuts the radial flange 88*e* of the sleeve 88. Upper surfaces of the upper ends 88*b* and 90*b* of the sleeve 88 and the drain flange 90, respectively, are aligned and would be visible in a sink and would preferably have the appearance of being smooth and continuous. Sleeve 88 may or may not be fastened to the drain flange 90. Sleeve 88 can be held in place by a pressure fit, a compression fit, a friction fit or by an adhesive. Sleeve 88 covers and seals the overflow ports 86*d*.

Figure 10:
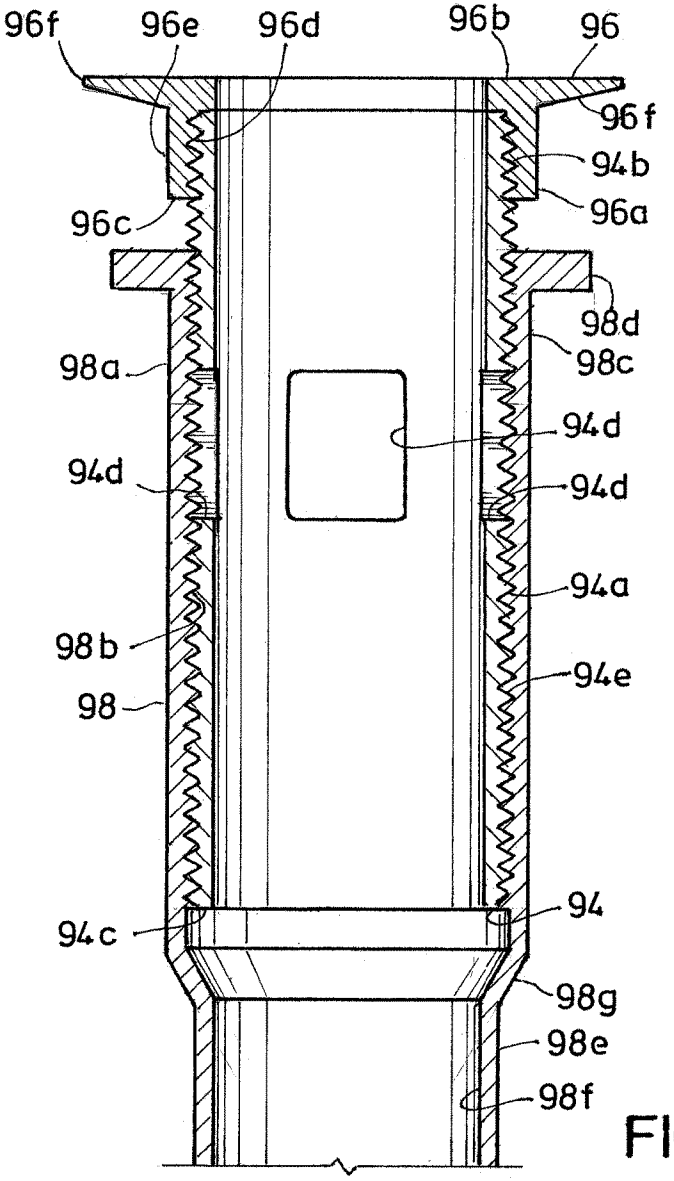
FIG. 10 is a cross-section of a side elevation of a drain pipe for a sink, according to the present invention.

FIG. 10 is a side elevation in cross-section of a drain pipe 94 similar to the drain pipe 50 in FIG. 2. Drain pipe 94 has a sidewall 94*a*, an upper end 94*b*, a lower end 94*c*, a plurality of overflow ports 94*d* and an outside surface 94*e* of the sidewall 94*a*. A drain flange 96 has a sidewall 96*a*, an upper end 96*b*, a lower end 96*c*, an inside surface 96*d* of the sidewall 96*a*, an outside surface 96*e* of the sidewall 96*a* and an outwardly extending radial flange 96*f* that would rest on a bottom surface of a sink and surround a drain opening. Drain flange 96 is in threaded engagement with drain pipe 94 and together would fit in a drain opening of a sink and would be sealed with the sink. If the sink has an overflow port and an overflow conduit, then overflow water will drain into the overflow ports 94*d*. However, if the sink is a vessel sink without an overflow port, then water would likely leak out through the ports 94*d* in the drain pipe 94. To seal the ports 94*d* in the drain pipe 94 when the drain pipe 94 and the drain flange 96 are used with a vessel sink that does not have an overflow port, an outer sleeve 98 is used to cover and seal the ports 94*d*. Outer sleeve 98 has an upper portion 98*a* that has an inside diameter and inside female threads 98*b* sized and designed to matingly and threadedly engage the outside surface 94*e*, which has male threads, of the drain pipe 94. The outer sleeve 98 has an upper end 98*c* and a radial flange 98*d* that extends radially outwardly with respect to the longitudinal axis of the outer sleeve 98. The outer sleeve 98 and its radial flange 98*d* can be used together with a gasket or a washer and gasket and/or plumber's putty between the flange 96*f* and an upper, inner surface of the sink around the drain opening to seal the drain pipe 94 and the drain flange 96 in the drain opening of a vessel sink. The outer sleeve 98 has a lower portion 98*e* that has an inside surface/diameter 98*f* that is about the same as the inside diameter of the drain pipe 94. An inwardly tapered transition portion 98*g* provides a transition between the inside diameter/surface 98*b* and the inside diameter/surface 98*f*. Outer sleeve 98 covers and seals the overflow ports 94*d* in the drain pipe 94 when the sink is a vessel sink. A kit can be sold that includes the drain pipe 94, the drain flange 96 and the outer sleeve 98 along with any washers, gaskets and nuts that may be useful.

Figure 11:
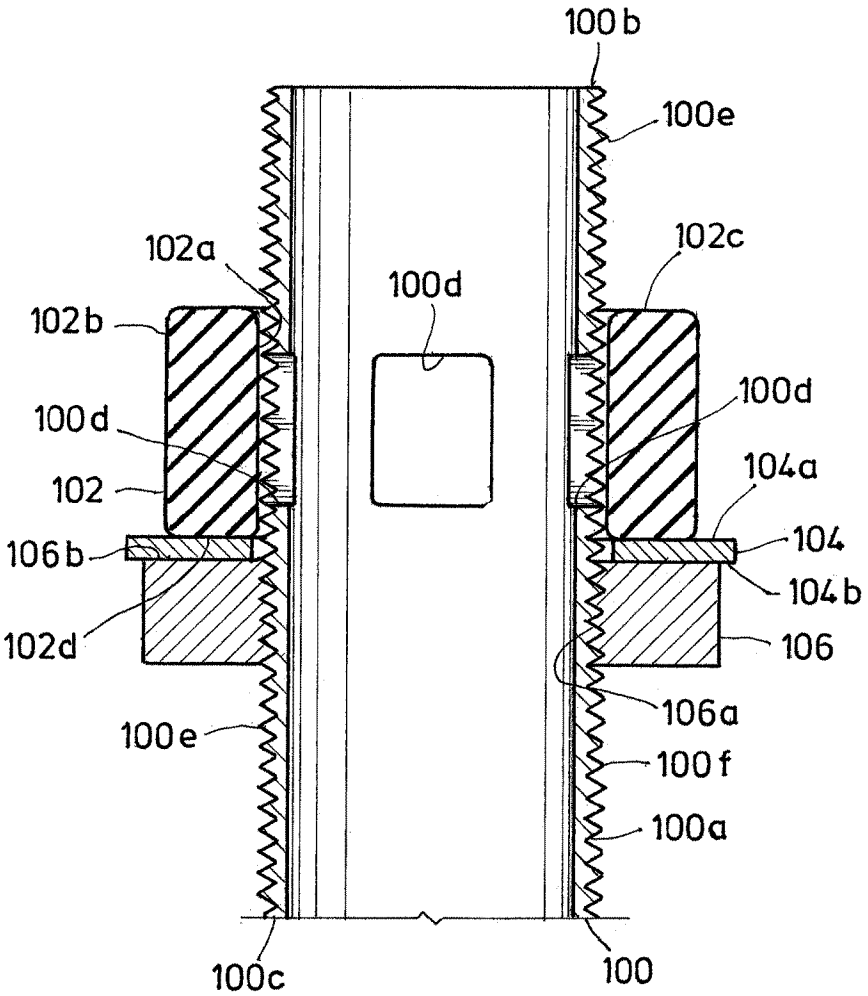
FIG. 11 is a cross-section of a side elevation of a drain pipe for a sink, according to the present invention.

FIG. 11 is a side elevation in cross-section of a drain pipe 100 similar to the drain pipe 50 in FIG. 2. Drain pipe 100 has a sidewall 100*a*, an upper end 100*b*, a lower end 100*c*, a plurality of overflow ports 100*d* and an outside surface 100*e* of the sidewall 100*a*, which has male threads 100*f*. A gasket or seal or resilient ring 102 surrounds and is in close proximity to the sidewall 100*a* of the drain pipe 100 and is located so as to cover the overflow ports 100*d*. Resilient ring 104 has an annular shape with an inner surface 102*a*, an outer surface 102*b*, an upper surface 102*c* and a lower surface 102*d*. A washer 104 is located below the resilient ring 102 and has an upper surface 104*a* located adjacent to and in contact with the lower surface 102*d* of the resilient ring 102. Washer 104 has a lower surface 104*b*. A nut 106 having female threads 106*a* is in threaded engagement with the male threads 100*f* on the outer surface 100*e* of the drain pipe 100. Nut 106 is located below washer 104, and washer 104 is between resilient ring 102 and nut 106. Nut 106 has an upper surface 106*b* that is that is adjacent to and in contact with the lower surface 104*b* of the washer 104.

A kit including a drain flange such as drain flange 96 in FIG. 10, the drain pipe 100, the resilient ring 102, the washer 104 and the nut 106 can be made and sold. The kit may also include the flexible gasket 20 shown in FIG. 1. The washer 104 and the nut 106 are likely interchangeable with the washer 20*a* and the threaded nut 20*b* in FIG. 1. The resilient ring 102 is more elongated than the gasket 20 in FIG. 1 so that the resilient ring 102 can cover and seal the overflow ports 100*d* in the drain pipe 100. If the drain pipe 100 is to be used in a conventional sink with an overflow port such as sink 12 in FIG. 1, then the elongated resilient ring 102 is not really needed and a gasket like gasket 20 can be used when fastening the drain pipe 100 in the sink. However, if the drain pipe 100 is to be used in a vessel sink that does not have an overflow port, then the drain flange can be threaded onto the upper end 100*b* of the drain pipe 100; the lower end 100*c* of the drain pipe 100 can be dropped through the drain opening in the sink; optionally, a second washer (not shown) can be placed around the drain pipe just below the bottom of the vessel sink; the resilient ring 102 is then placed on the drain pipe below the second washer if one is used or just below and in contact with the bottom of the vessel sink; the washer 104 is placed below and in contact with the lower surface 102*d* of the resilient ring 102; and the nut 106 is placed below the washer 104 so that the upper surface 106*b* of the nut 106 is in contact with the lower surface 104*b* of the washer 104. The nut 106 is tightened, which presses the resilient ring 102 against the bottom of the vessel sink. The gasket, seal or ring 102 is made of a material that is firm, but compressible, which is preferably resilient and waterproof or impervious to water. Suitable materials may include an elastomeric polymeric material, synthetic or natural rubber or a closed-cell foam. Tightening of the nut 106 compresses the ring 102, which presses the inner surface 102*a* of the ring 102 against the outside surface 100*e* of the drain pipe 100, thereby covering and sealing the overflow ports 100*d* of the drain pipe 100.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain pipe for connection to a sink having a drain opening, comprising:

a pipe having a sidewall, a length and opposing upper and lower ends, wherein the sidewall defines an interior fluid flow passageway in the pipe, wherein the sidewall has an outside surface, and wherein the sidewall has a port for receiving water from the sink through an overflow channel for use with sinks that have an overflow port;

a flange on the upper end of the pipe that extends radially, wherein the flange and pipe are sized so that the pipe will pass through the drain opening, and wherein the flange will not pass through the drain opening; and a tubular sleeve surrounding the pipe and sealing the port for use with sinks that do not have an overflow port so that water cannot pass through the port, wherein the tubular sleeve has open opposing ends but does not otherwise have an opening.

2. The drain pipe of claim 1, wherein the outside surface of the sidewall has external threads, wherein the tubular sleeve has internal threads, and wherein the tubular sleeve surrounds the pipe in a threaded engagement and seals the port.

3. A drain body for connection to a sink having a drain opening, wherein the sink may or may not have an overflow port, the drain body comprising:

a drain pipe having a length, an open upper end, an open lower end, a sidewall that defines an interior fluid flow passageway, and an opening through the sidewall proximal to the upper end for providing fluid communication with the overflow port;

a drain flange attached to or formed integral with the upper end of the pipe; and a tubular sleeve that surrounds, covers and seals the opening in the sidewall of the pipe, thereby preventing water from passing through the opening, wherein the tubular sleeve has a sleeve wall between opposing open ends, and wherein the sleeve wall does not have a hole.

4. The drain body of claim 3, wherein the sidewall of the drain pipe has external threads on an outside surface, wherein the sleeve wall has an internal surface with internal threads for engaging with the external threads on the sidewall of the pipe.

5. The drain body of claim 3, wherein the drain pipe has an outside surface that has external threads, and wherein the tubular sleeve surrounds the drain pipe in a threaded engagement and seals the opening through the sidewall of the drain pipe.

6. The drain body of claim 5, wherein the tubular sleeve has an inside surface that has internal threads.

7. A kit, comprising:

a drain body for connection to a sink having a drain opening, the drain body comprising:

a pipe having a sidewall, a length and opposing upper and lower ends, wherein the sidewall defines an interior fluid flow passageway in the pipe;

a flange formed integral with or attachable to the upper end that extends radially, wherein the flange and pipe are sized so that the pipe will pass through the drain opening, and wherein the flange will not pass through the drain opening;

a port in the sidewall for receiving water from the sink through an overflow channel if the sink has an overflow port; and a tubular sleeve that is designed, sized and configured to surround, cover and seal the port in the sidewall of the pipe for use with a vessel sink that does not have an overflow channel, wherein the tubular sleeve comprises a sleeve wall between opposing open ends, wherein the sleeve wall does not have a hole, and wherein the tubular sleeve is not used for a sink that has an overflow channel.

8. The kit of claim 7, wherein the sidewall of the pipe has external threads on an outside surface, wherein the sleeve wall has an internal surface with internal threads for engaging with the external threads on the sidewall of the pipe.

* * * * *